US009437925B2

(12) United States Patent
Wong et al.

(10) Patent No.: US 9,437,925 B2
(45) Date of Patent: Sep. 6, 2016

(54) COMMUNICATION DEVICE AND ANTENNA ELEMENT THEREIN

(71) Applicant: Acer Incorporated, New Taipei (TW)

(72) Inventors: Kin-Lu Wong, New Taipei (TW); Hung-Jen Hsu, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 239 days.

(21) Appl. No.: 14/205,763

(22) Filed: Mar. 12, 2014

(65) Prior Publication Data

US 2015/0162659 A1 Jun. 11, 2015

(30) Foreign Application Priority Data

Dec. 11, 2013 (TW) ..... 102145503 A

(51) Int. Cl.

| | |
|---|---|
| ***H01Q 5/371*** | (2015.01) |
| ***H01Q 7/00*** | (2006.01) |
| ***H01Q 5/378*** | (2015.01) |
| ***H01Q 1/24*** | (2006.01) |
| ***H01Q 5/321*** | (2015.01) |

(52) U.S. Cl.

CPC ..... *H01Q 5/371* (2015.01); *H01Q 1/243* (2013.01); *H01Q 5/321* (2015.01); *H01Q 5/378* (2015.01); *H01Q 7/00* (2013.01)

(58) Field of Classification Search

None

See application file for complete search history.

(56) References Cited

U.S. PATENT DOCUMENTS

| | | | | |
|---|---|---|---|---|
| 8,547,283 | B2 | 10/2013 | Wong et al. | |
| 2012/0001815 | A1* | 1/2012 | Wong | H01Q 1/243 343/749 |
| 2013/0021209 | A1* | 1/2013 | Fan | H01Q 5/371 343/700 MS |

FOREIGN PATENT DOCUMENTS

| | | |
|---|---|---|
| TW | 201203703 | 1/2012 |

OTHER PUBLICATIONS

Chinese language office action dated Nov. 19, 2015, issued in application No. TW 102145503.

* cited by examiner

*Primary Examiner* — Robert Karacsony

(74) *Attorney, Agent, or Firm* — McClure, Qualey & Rodack, LLP

(57) ABSTRACT

A communication device including a ground element and an antenna element is provided. The antenna element is disposed adjacent to an edge of the ground element. The antenna element includes a loop metal element and a branch metal element. The loop metal element has a first end and a second end. The first end is coupled to a signal source. The second end is coupled to the ground element. The loop metal element includes a first segment and a second segment. The first segment is separated from the second segment by a gap. The first segment includes the first end, and the second segment includes the second end. The branch metal element has a third end and a fourth end. The third end is coupled through an inductive element to a connection point on the loop metal element. The fourth end is open.

8 Claims, 5 Drawing Sheets

COMMUNICATION DEVICE AND ANTENNA ELEMENT THEREIN

CROSS REFERENCE TO RELATED APPLICATIONS

This Application claims priority of Taiwan Patent Application No. 102145503 filed on Dec. 11, 2013, the entirety of which is incorporated by reference herein.

BACKGROUND OF THE INVENTION

1. Field of the Invention

The disclosure generally relates to a communication device, and more particularly, to a communication device and a small-size, multi-band antenna element therein.

2. Description of the Related Art

With the rapid development of mobile communication technologies, a variety of related products are continuously being promoted and innovated. Nowadays, mobile communication devices require higher transmission speeds to provide convenience and immediacy of use for users. Since the design of mobile communication devices is becoming lighter and thinner, the spacing between display and frame may become much smaller. As a result, there is reduced space for accommodating antenna elements. Accordingly, it is a critical challenge for antenna designers to design a small-size, multi-band antenna in a thin mobile communication device.

BRIEF SUMMARY OF THE INVENTION

To solve the problem of the prior art, the invention provides a communication device and an antenna element therein. The antenna element has a small-size, planar structure, and it is capable of covering at least LTE/WWAN (Long Term Evolution/Wireless Wide Area Network) multiple frequency bands (e.g., from about 1710 MHz to about 2690 MHz, and from about 824 MHz to about 960 MHz) without including any additional matching circuit. For example, the proposed antenna element may be formed on an FR4 (Flame Retardant 4) substrate with a thickness of about 0.4mm, and a total area of the proposed antenna element may be merely about 10×35 $mm^2$. The antenna element of the invention has bandwidth of at least 1500 MHz in high frequency bands, and it is therefore suitable for covering high frequency ranges of a variety of mobile communication products.

In a preferred embodiment, the invention provides a communication device, comprising: a ground element; and an antenna element, disposed adjacent to an edge of the ground element, wherein the antenna element comprises: a loop metal element, having a first end and a second end, wherein the first end is coupled to a signal source, the second end is coupled to the ground element, the loop metal element comprises a first segment and a second segment, the first segment is separated from the second segment by a gap, the first segment comprises the first end, and the second segment comprises the second end; and a branch metal element, having a third end and a fourth end, wherein the third end is coupled through an inductive element to a connection point on the loop metal element, the fourth end is open, and a length of the branch metal element is longer than a length of the first segment.

The antenna element can provide at least two wide frequency bands to cover multi-band operations of mobile communication products. The antenna element may substantially have a planar structure formed on a surface of a dielectric substrate. Since the antenna structure is relatively simple, it is easy to manufacture the antenna element, and the antenna element is suitably applied to a variety of thin tablet communication devices. The above two wide frequency bands are generated by exciting the loop metal element and the branch metal element, respectively. As a result, a designer can easily adjust the operation frequency of these frequency bands. The loop metal element may be divided into the first segment and the second segment by the gap. In some embodiments, the length of the first segment is at least 0.5 times the length of the second segment. In alternative embodiments, the length of the second segment is at least 0.5 times the length of the first segment. By using the aforementioned length ratio, a first resonant mode excited by the first segment can be combined with a second resonant mode excited by the second segment to form the wide first frequency band and to cover multi-band operations of mobile communication products. For example, the first frequency band may cover high frequency ranges of LTE/WWAN frequency bands from about 1700 MHz to about 2700 MHz.

In some embodiments, the gap of the loop metal element substantially has a step shape. In alternative embodiments, the gap of the loop metal element substantially has a straight-segment shape. An angle may be formed between an extension straight-line of the straight-segment shape and the edge of the ground element, and the angle may not be orthogonal. With such a design, a first open end of the first segment has a first bevel edge (the first open end is adjacent to the gap), and the first bevel edge can cause continuous resonant lengths to be formed from the first end of the loop metal element to the first open end of the first segment, thereby increasing impedance bandwidth of the corresponding first resonant mode. Similarly, a second open end of the second segment has a second bevel edge (the second open end is adjacent to the gap), and the second bevel edge can also cause continuous resonant lengths to be formed from the second end of the loop metal element to the second open end of the second segment, thereby increasing impedance bandwidth of the corresponding second resonant mode. Therefore, the bandwidth of the first frequency band can be significantly increased by combining the first resonant mode with the second resonant mode.

In some embodiments, the first end and the second end of the loop metal element are close to each other, such that the loop metal element substantially surrounds an inverted L-shaped region. Such a design can reduce the size of the loop metal element, thereby further reducing the total size of the antenna element.

In the antenna element, the branch metal element is coupled through the inductive element to the loop metal element. The inductive element may be a lumped inductor (e.g., a chip inductor) or a distributed inductor. Since the inductive element has a high inductance in high frequency bands and is nearly open-circuited, the branch metal element substantially does not affect the loop metal element operating in the wide first frequency band. Furthermore, the length of the branch metal element is at least longer than the length of the first segment, such that a resonant path is formed from the first end of the loop metal element through the inductive element to the branch metal element and is further excited to generate a third resonant mode. The third resonant mode may form a second frequency band of the antenna element, and the second frequency band is lower than the first frequency band. For example, the second frequency band may cover low frequency ranges of LTE/WWAN frequency bands from about 824 MHz to 960 MHz.

In some embodiments, the planar antenna element is implemented through a printing process (e.g., the inductive element may be implemented with a distributed inductor). In some embodiments, the gap of the loop metal element is positioned between the branch metal element and the edge of the ground element. The antenna element may have low-profile characteristics and a small size of about 10×35 $mm^2$, and it can provide the wide first and second frequency bands, which may cover multiple frequency ranges from about 824 MHz to about 960 MHz, and further from about 1710 MHz to about 2690 MHz.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention are described in detail as follows.

Figure 1:
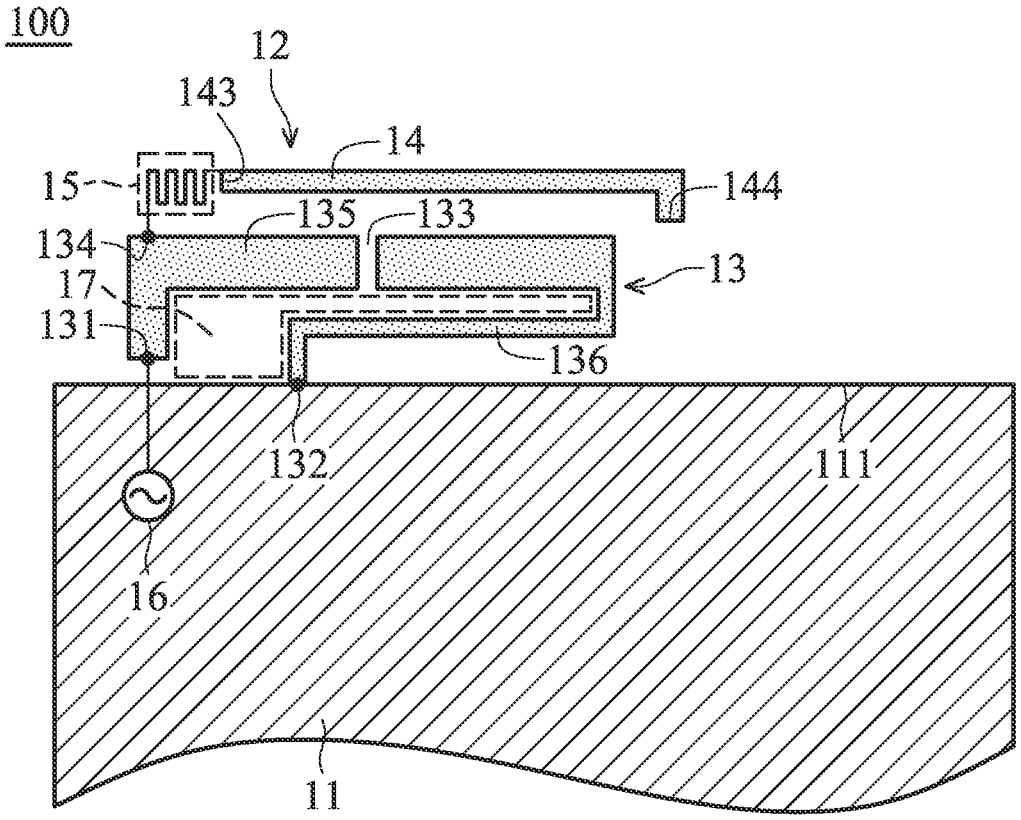
FIG. 1 is a diagram for illustrating a communication device according to a first embodiment of the invention.

FIG. 1 is a diagram for illustrating a communication device 100 according to a first embodiment of the invention. The communication device 100 may be a smartphone, a tablet computer, or a notebook computer. As shown in FIG. 1, the communication device 100 at least comprises a ground element 11 and an antenna element 12. The antenna element 12 is disposed adjacent to an edge 111 of the ground element 11. The antenna element 12 comprises a loop metal element 13 and a branch metal element 14. The loop metal element 13 has a first end 131 and a second end 132. The first end 131 of the loop metal element 13 is coupled to a signal source 16. The signal source 16 may be an RF (Radio Frequency) module for exciting the antenna element 12. The second end 132 of the loop metal element 13 is coupled to the ground element 11. The loop metal element 13 may substantially surround an inverted L-shaped region 17. The loop metal element 13 comprises a first segment 135 and a second segment 136. The first segment 135 may be completely separated from the second segment 136 by a gap 133. The gap 133 of the loop metal element 13 may be positioned between the branch metal element 14 and the edge 111 of the ground element 11. The first segment 135 may substantially have an inverted L-shape. The second segment 136 may substantially have an inverted J-shape. The first segment 135 comprises the first end 131 of the loop metal element 13. The second segment 136 comprises the second end 132 of the loop metal element 13. The length of the first segment 135 may be at least 0.5 times the length of the second segment 136, or the length of the second segment 136 may be at least 0.5 times the length of the first segment 135. The branch metal element 14 may substantially have a straight-line shape or an inverted L-shape. The branch metal element 14 has a third end 143 and a fourth end 144. The third end 143 of the branch metal element 14 is coupled through an inductive element 15 to a connection point 134 on the first segment 135 of the loop metal element 13. The fourth end 144 of the branch metal element 14 is open. The length of the branch metal element 14 is longer than the length of the first segment 135. The inductive element 15 may be a distributed inductor. The inductive element 15, the loop metal element 13, and the branch metal element 14 may all be formed on a dielectric substrate (e.g., an FR4 (Flame Retardant 4) substrate) through a printing process, thereby reducing the total manufacturing cost. Note that the communication device 100 may further comprise other components, such as a touch panel, a processor, a speaker, a battery, and a housing (not shown).

Figure 2:
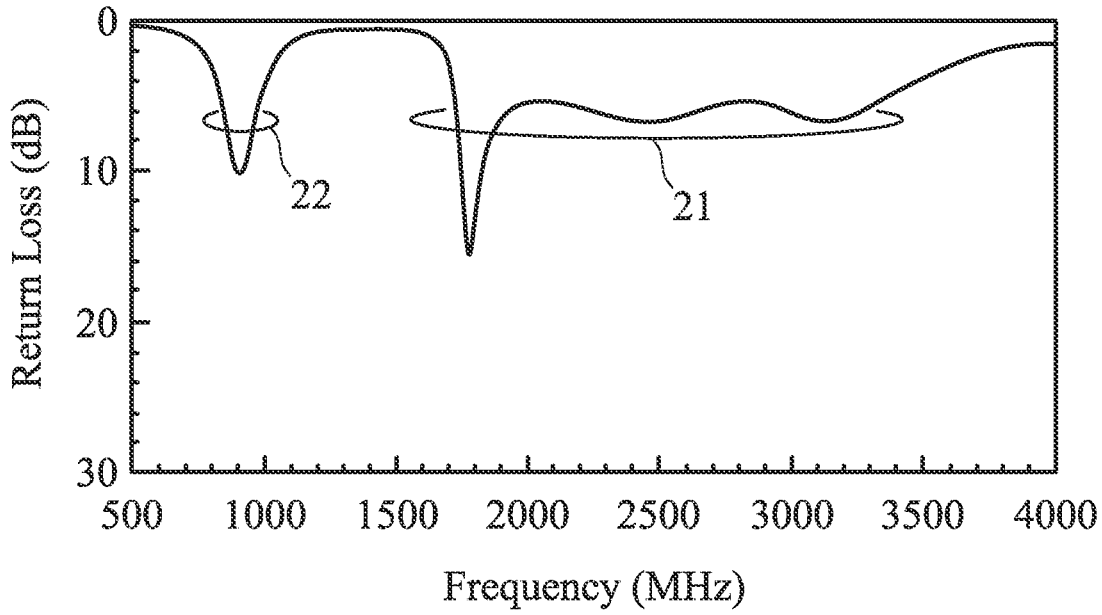
FIG. 2 is a diagram for illustrating return loss of an antenna element of a communication device according to a first embodiment of the invention.

FIG. 2 is a diagram for illustrating return loss of the antenna element 12 of the communication device 100 according to the first embodiment of the invention. In some embodiments, the element sizes and element parameters of the communication device 100 are described as follows. The ground element 11 has a length of about 200 mm and a width of about 150 mm. The size of the ground element 11 is substantially equivalent to a typical ground plane size of a 9.7" tablet computer. The antenna element 12 has a length of about 35 mm and a width of about 10 mm. The antenna element 12 may have low-profile and small-size characteristics, and may be formed on an FR4 substrate with a thickness of about 0.4 mm. As shown in FIG. 2, the antenna element 12 of the communication device 100 covers a first frequency band 21 and a second frequency band 22. The higher first frequency band 21 may have bandwidth of at least 1500 MHz (the bandwidth is from about 1700 MHz to about 3200 MHz), and may cover GSM1800/1900/UMTS/LTE2300/2500 mobile communication bands (e.g., from about 1710 MHz to about 2690 MHz). In addition, the lower second frequency band 22 may cover GSM850/900 mobile communication bands (e.g., from about 824 MHz to about 960 MHz).

Figure 3:
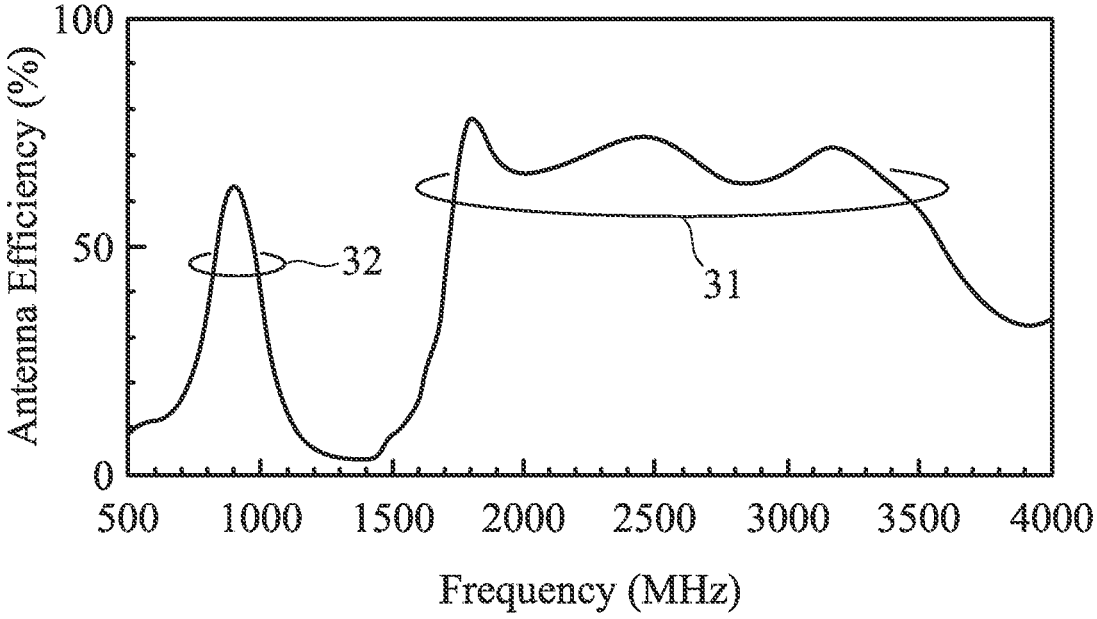
FIG. 3 is a diagram for illustrating antenna efficiency of an antenna element of a communication device according to a first embodiment of the invention.

FIG. 3 is a diagram for illustrating antenna efficiency of the antenna element 12 of the communication device 100 according to the first embodiment of the invention. It is understood that the aforementioned antenna efficiency is the radiation efficiency including the return loss. As shown in FIG. 3, the antenna efficiency 31 of the antenna element 12 which operates in the first bands 21 (e.g., from about 1710 MHz to about 2690 MHz) is from about 52% to about 77%. The antenna efficiency 31 of the antenna element 12 which operates in the frequency bands from 1710 MHz to 3600 MHz is all greater than 50%. In addition, the antenna efficiency 32 of the antenna element 12 which operates in the second bands 22 (e.g., from about 824 MHz to about 960 MHz) is from about 45% to about 62%. The above antenna efficiency can meet the requirements of practical applications of mobile communication devices.

Figure 4:
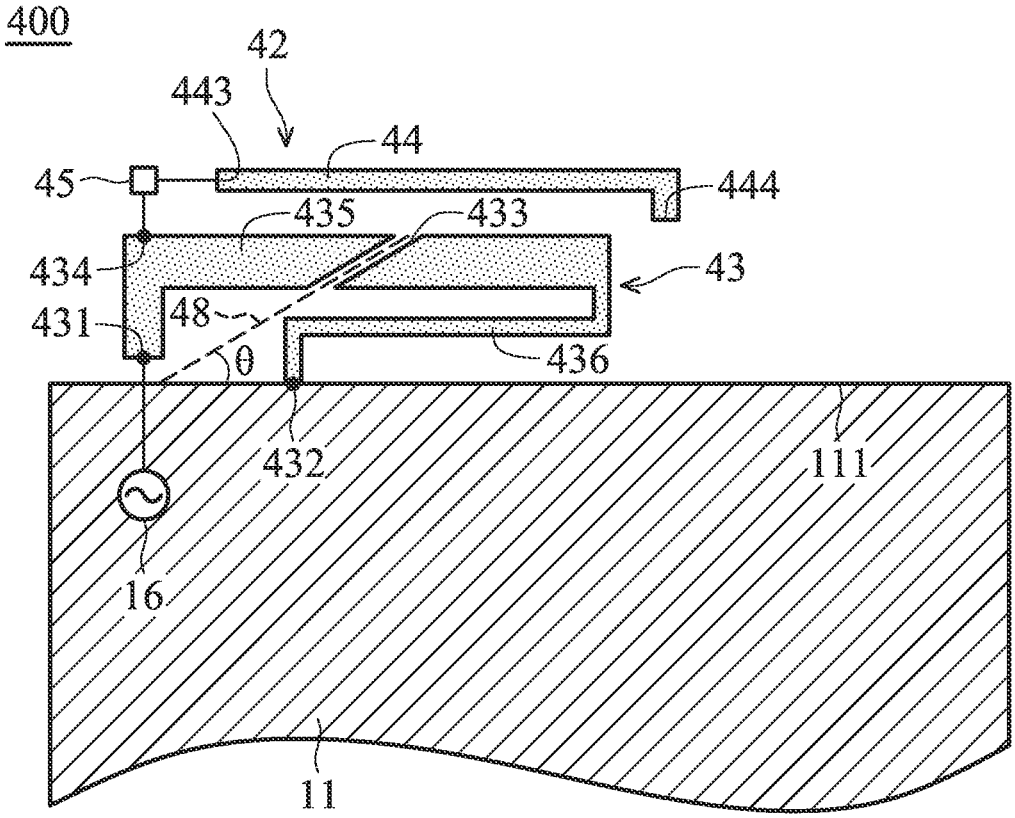
FIG. 4 is a diagram for illustrating a communication device according to a second embodiment of the invention.

FIG. 4 is a diagram for illustrating a communication device 400 according to a second embodiment of the invention. In an antenna element 42 of the second embodiment, a third end 443 of a branch metal element 44 is coupled through an inductive element 45 to a connection point 434 on a first segment 435 of a loop metal element 43. The inductive element 45 is a lumped inductor (e.g., a chip inductor). Furthermore, a gap 433 of the loop metal element 43 substantially has a straight-segment shape. An angle θ is formed between an extension straight-line 48 of the straight-segment shape and the edge 111 of the ground element 11, and the angle θ is not equal to 90 degrees (i.e., not orthogonal). For example, the angle θ may be from about 0 to 45 degrees. Other features of the second embodiment are similar to those of the first embodiment. Therefore, the two embodiments can achieve similar levels of performance.

Figure 5:
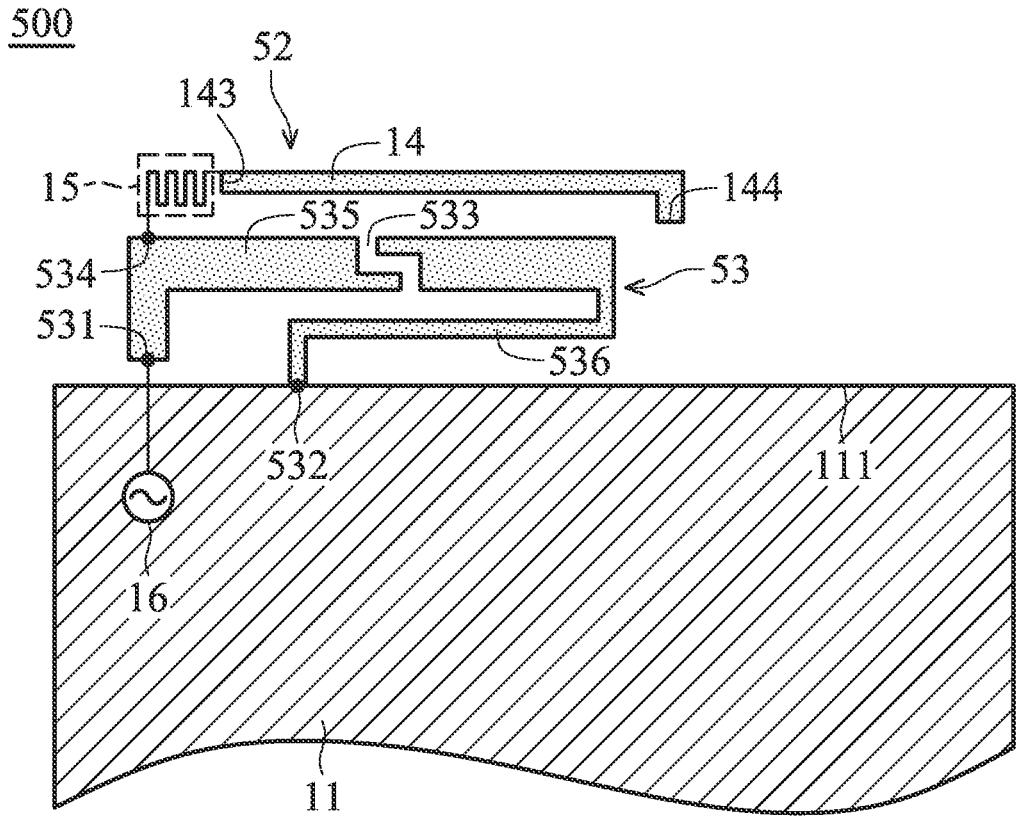
FIG. 5 is a diagram for illustrating a communication device according to a third embodiment of the invention.

FIG. 5 is a diagram for illustrating a communication device 500 according to a third embodiment of the invention. In an antenna element 52 of the third embodiment, a gap 533 of a loop metal element 53 substantially has a step shape. More particularly, the step shape may be substantially an N-shape. Other features of the third embodiment are similar to those of the first embodiment. Therefore, the two embodiments can achieve similar levels of performance.

Note that the above element sizes, element shapes, and frequency ranges are not limitations of the invention. An antenna designer can fine tune these settings or values according to different requirements. It is understood that the communication device and the antenna structure of the invention are not limited to the configurations of FIGS. 1-5. The invention may merely include any one or more features of any one or more embodiments of FIGS. 1-5. In other words, not all of the features displayed in the figures should be implemented in the communication device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element; and an antenna element, disposed adjacent to an edge of the ground element, wherein the antenna element comprises:

a loop metal element, having a first end and a second end, wherein the first end is coupled to a signal source, the second end is coupled to the ground element, the loop metal element comprises a first segment and a second segment, the first segment is separated from the second segment by a gap, the first segment comprises the first end, and the second segment comprises the second end; and a branch metal element, having a third end and a fourth end, wherein the third end is coupled through an inductive element to a connection point on the loop metal element, the fourth end is open, and a length of the branch metal element is longer than a length of the first segment;

wherein the gap substantially has a straight-segment shape;

wherein an angle is formed between an extension straight-line of the straight-segment shape and the edge of the ground element, and the angle is not orthogonal;

wherein the angle is from 0 to 45 degrees.

2. The communication device as claimed in claim 1, wherein the gap substantially has a straight-segment shape.

3. The communication device as claimed in claim 1, wherein the gap substantially has a step shape.

4. The communication device as claimed in claim 1, wherein the inductive element is a lumped inductor.

5. The communication device as claimed in claim 1, wherein the inductive element is a distributed inductor.

6. The communication device as claimed in claim 1, wherein the antenna element substantially has a planar structure, and the gap of the loop metal element is positioned between the branch metal element and the edge of the ground element.

7. The communication device as claimed in claim 1, wherein the length of the first segment is at least 0.5 times the length of the second segment.

8. The communication device as claimed in claim 1, wherein the length of the second segment is at least 0.5 times the length of the first segment.

* * * * *